US006068741A

United States Patent [19]

Lin

[11] Patent Number: 6,068,741

[45] Date of Patent: May 30, 2000

[54] OXYGEN AND HYDROGEN GENERATOR

[76] Inventor: Wen Chang Lin, No. 115, Lane 320, Gong Yeh 2nd Road, Lin Yuan Hsiang Kaoshiung Hsien, Taiwan

[21] Appl. No.: 09/145,456

[22] Filed: Sep. 2, 1998

[51] Int. Cl.[7] ..... C25B 9/00; C25B 15/08

[52] U.S. Cl. ..... 204/239; 204/270; 204/274; 204/278

[58] Field of Search ..... 204/270, 274, 204/277, 278, 237, 239, 241

[56] References Cited

U.S. PATENT DOCUMENTS 4,317,709 3/1982 Ichisaka et al. ..... 204/274 X 5,614,069 3/1997 Lin ..... 204/274 X 5,888,361 3/1999 Hirai et al. ..... 204/274 X

*Primary Examiner*—Donald R. Valentine

[57] ABSTRACT

A gas generator includes a housing for receiving an electrolyte and has an outlet duct for collecting the gas. A number of cells are disposed in the housing for forming a number of spaces between the cells. A tube and a pipe are coupled together by a conduit and are engaged through the cells and each has a number of holes communicating with the spaces for allowing the electrolyte to be drawn out of the housing to a cool device and for allowing the electrolyte to be circulate into the housing via the pipe. An indicator is used for indicating the level of the electrolyte.

7 Claims, 3 Drawing Sheets

OXYGEN AND HYDROGEN GENERATOR

BACKGROUND OF THE INVENTION

1. Field of the Invention

The present invention relates to a gas generator, and more particularly to an improved oxygen and hydrogen generator.

2. Description of the Prior Art

Typical gas generators, particularly the oxygen and hydrogen generators comprise an electrolytic furnace having a number of cells immersed in electrolyte for generating the oxygen and hydrogen when the cells are energized. The oxygen and hydrogen may be supplied to a gas welder or a gas cutting device as a fuel gas. However, it will be difficult to cool the electrolyte and to refill electrolyte into the furnace during the electrolytic operation.

The present invention has arisen to mitigate and/or obviate the afore-described disadvantages of the conventional oxygen and hydrogen generators.

SUMMARY OF THE INVENTION

The primary objective of the present invention is to provide an oxygen and hydrogen generator including a configuration for allowing the electrolyte to be easily introduced into the generator and for allowing the electrolyte to be easily cooled down.

In accordance with one aspect of the invention, there is provided a gas generator for generating a gas, the generator comprising a housing including a chamber formed therein for receiving an electrolyte and including an outlet duct for collecting the gas, a plurality of cells disposed in the housing for defining a plurality of spaces between the cells, the cells each including an orifice and an aperture formed therein, a tube engaged through the orifices of the cells and including a plurality of holes communicating with the spaces for receiving the electrolyte, a pipe engaged through the apertures of the cells and including a plurality of punctures communicating with the spaces for filling the electrolyte into the spaces, a conduit coupling the tube to the pipe, means for circulating the electrolyte from the tube to the pipe, and means for cooling the electrolyte.

The cells each includes a lower portion and an upper portion, the orifices are formed in the lower portions of the cells and the apertures are formed in the upper portions of the cells.

The cooling means includes a casing and a fan disposed in the casing, the conduit includes a folded portion disposed in the casing for allowing the electrolyte in the folded portion of the conduit to be cooled down by the fan.

The cells each includes an upper portion having an opening formed therein for allowing the gas to flow through the cells. The openings of the cells are aligned with the outlet duct of the housing.

An indicator means is further provided for indicating a level of the electrolyte. A refilling means is further provided for refilling the electrolyte into the pipe when the level of the electrolyte is decreased than a predetermined level.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
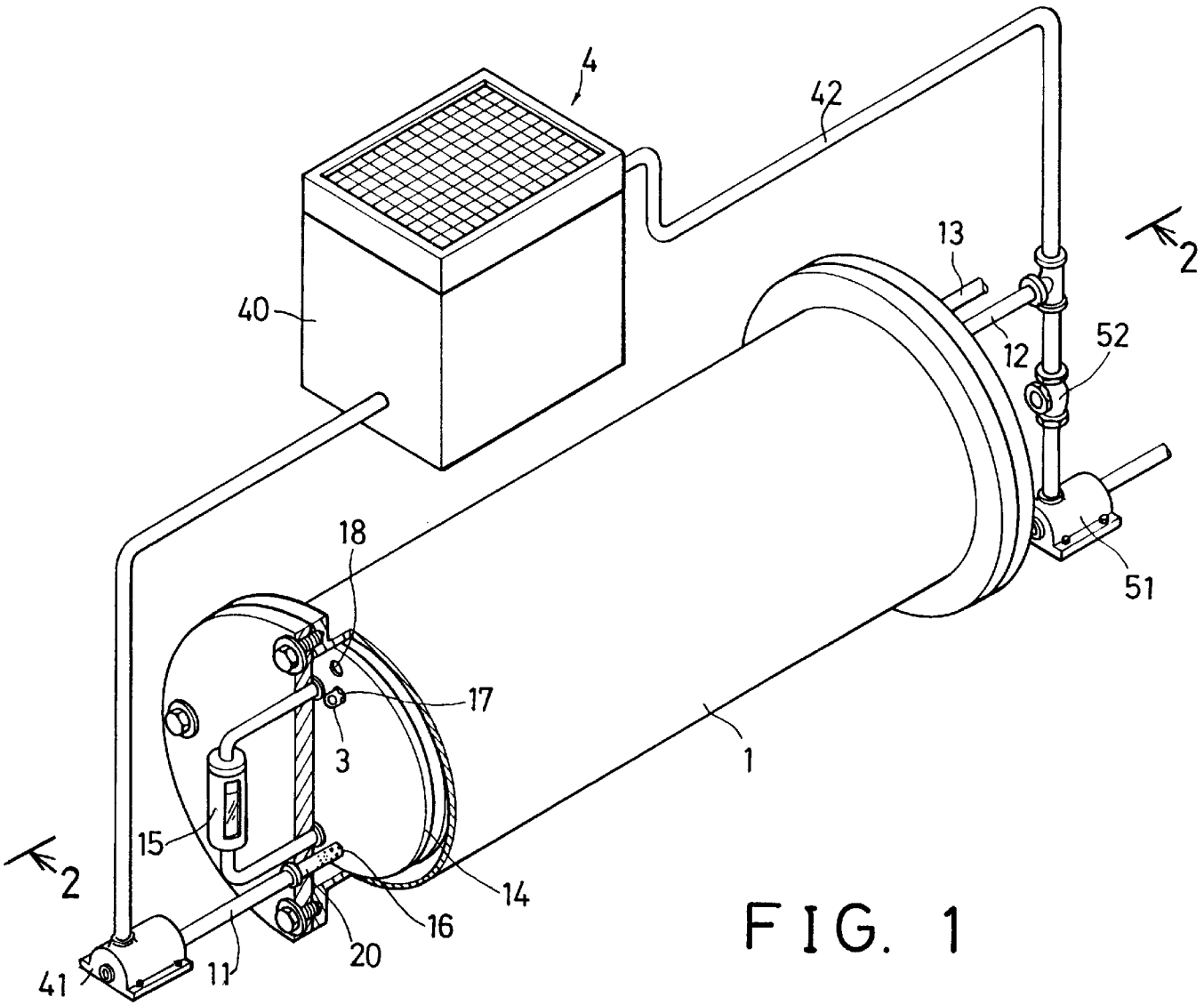
FIG. 1 is a perspective view of an oxygen and hydrogen generator in accordance with the present invention.
Figure 2:
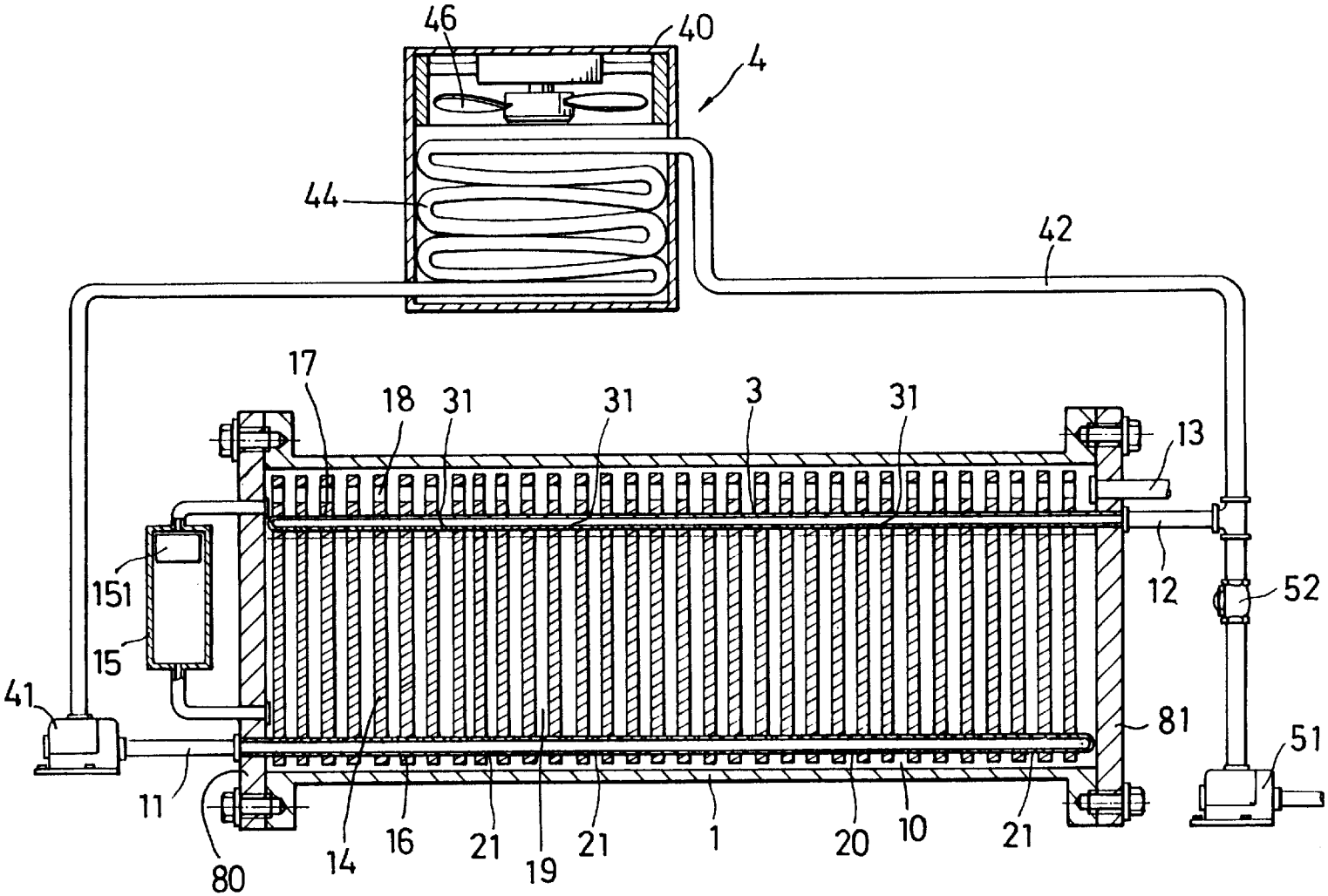
FIG. 2 is a cross sectional view taken along lines 2—2 of FIG. 1.

Referring to the drawings, an oxygen and hydrogen generator in accordance with the present invention comprises a housing 1 including two caps 80, 81 secured to the ends and including a number of cells 14 secured in the chamber 10 of the housing 1 for generating oxygen and/or hydrogen when the cells 14 are energized. The cells 14 each includes an orifice 16 formed in the lower portion and an aperture 17 and an opening 18 formed in the upper portion. A tube 20 is engaged through the orifices 16 and coupled to a pump 41 via an outlet or an outlet hose 11 and has a number of holes 21 communicating with the spaces 19 formed between the cells 14. A pipe 3 is engaged through the apertures 17 and coupled to an inlet or an inlet hose 12 and has a number of punctures 31 communicating with the spaces 19. An outlet duct 13 is coupled to the housing 1 and preferably aligned with the openings 18 for collecting the oxygen and the hydrogen.

The pump 41 is coupled between the outlet hose 11 and the inlet hose 12 via a conduit 42 which includes a folded portion 44 disposed in a casing 40 of a cooling device 4. The pump 41 may pump and circulate the electrolyte from the tube 20 to the pipe 3 via the cooling device 4 which includes a fan 46 for cooling the electrolyte. Alternatively, the cooling device 4 may cool the electrolyte by cold water or by the other cold media. An indicator 15 is coupled to the housing 1 and has a float 151 for indicating the level of the electrolyte. A pump 51 is coupled to the inlet hose 12 for pumping further electrolyte into the housing 1. A check valve 52 is disposed between the pump 51 and the inlet hose 12 and/or the conduit for preventing the electrolyte from flowing back to the pump 51.

Figure 3:
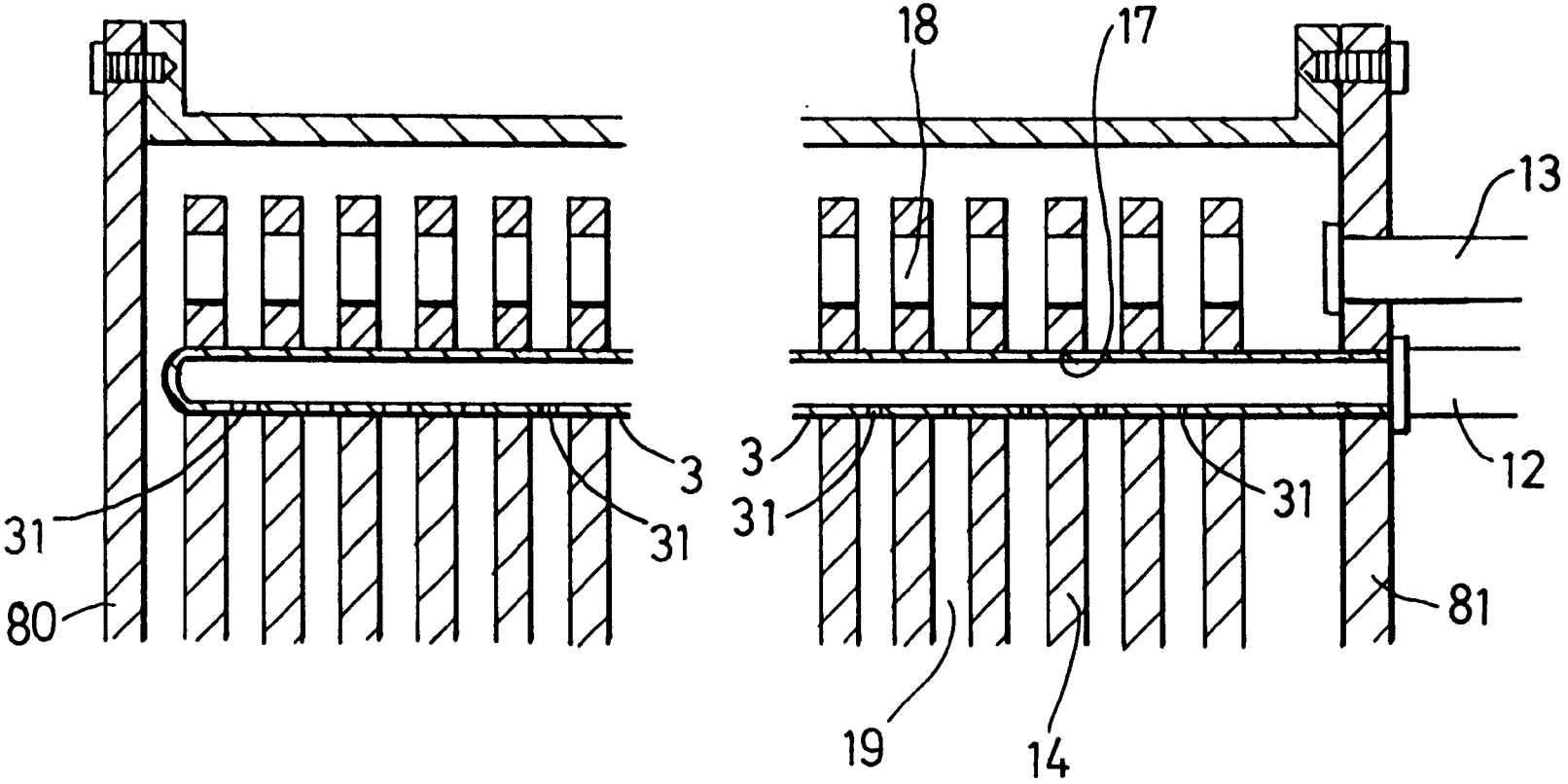
FIG. 3 is an enlarged partial cross sectional view of the oxygen and hydrogen generator.

As best shown in FIG. 3, the punctures 31 of the pipe 3 includes a size gradually increased from the end closer to the inlet hose 12 to the end closer to the cap 80, for allowing the electrolyte to be uniformly distributed into the spaces 19. Similarly, the holes 21 of the tube 20 includes a size gradually increased from the end closer to the outlet hose 12 to the end closer to the cap 81, for allowing the electrolyte to be uniformly drawn from the spaces 19 to the conduit 42. It is preferable that the pipe 3 is disposed above the tube 20.

Accordingly, the gas generator in accordance with the present invention includes a configuration for allowing the electrolyte to be easily introduced into the generator and for allowing the electrolyte to be easily cooled down.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A gas generator for generating a gas, said generator comprising:

a housing including a chamber formed therein for receiving an electrolyte and including an outlet duct for collecting the gas, a plurality of cells disposed in said housing for defining a plurality of spaces between said cells, said cells each including an orifice and an aperture formed therein, a tube engaged through said orifices of said cells and including a plurality of holes communicating with said spaces for receiving the electrolyte, a pipe engaged through said apertures of said cells and including a plurality of punctures communicating with said spaces for filling the electrolyte into said spaces, a conduit coupling said tube to said pipe, means for circulating the electrolyte from said tube to said pipe, and means for cooling the electrolyte.

2. The gas generator according to claim 1, wherein said cells each includes a lower portion and an upper portion, said orifices are formed in said lower portions of said cells and said apertures are formed in said upper portions of said cells.

3. The gas generator according to claim 1, wherein said cooling means includes a casing and a fan disposed in said casing, said conduit includes a folded portion disposed in said casing for allowing the electrolyte in said folded portion of the conduit to be cooled down by said fan.

4. The gas generator according to claim 1 further comprising an indicator means for indicating a level of the electrolyte.

5. The gas generator according to claim 1, wherein said cells each includes an upper portion having an opening formed therein for allowing the gas to flow through said cells.

6. The gas generator according to claim 5, wherein said openings of said cells are aligned with said outlet duct of said housing.

7. The gas generator according to claim 1 further comprising means for refilling the electrolyte into said pipe.

* * * * *